US005279057A

United States Patent [19]

Melin et al.

[11] Patent Number: 5,279,057

[45] Date of Patent: Jan. 18, 1994

[54] DEVICE FOR THE IDENTIFICATION OF OBJECTS

[75] Inventors: Per Melin; Christian Ackerfors, both of Norrkoping, Sweden

[73] Assignee: Lindome PMP Teknik AB, Lindome, Sweden

[21] Appl. No.: 4,772

[22] Filed: Jan. 14, 1993

Related U.S. Application Data

[63] Continuation of Ser. No. 761,817, Sep. 20, 1991, abandoned.

[30] Foreign Application Priority Data

Mar. 31, 1989 [SE] Sweden ..... 8901125

[51] Int. Cl.[5] ..... G09F 3/10

[52] U.S. Cl. ..... 40/630; 40/633

[58] Field of Search ..... 40/299, 630, 633, 638, 40/637

[56] References Cited

U.S. PATENT DOCUMENTS

| | | | |
|---|---|---|---|
| 1,806,142 | 5/1931 | Beck | 40/633 |
| 2,098,164 | 11/1937 | Rice . | |
| 3,153,869 | 10/1964 | Twentier | 40/633 |
| 3,197,899 | 8/1965 | Twentier . | |
| 3,228,129 | 1/1966 | Gwinn et al. . | |
| 3,864,855 | 2/1975 | Pekko et al. | 40/638 X |
| 4,082,873 | 4/1978 | Williams | 40/638 X |
| 4,121,003 | 10/1978 | Williams | 40/638 X |
| 4,184,701 | 1/1980 | Franklin et al. | 40/638 X |
| 4,783,917 | 11/1988 | Smith et al. | 40/633 |
| 4,817,310 | 4/1989 | Breen et al. | 40/299 |
| 4,887,845 | 12/1989 | Nagai | 40/637 X |

*Primary Examiner*—Peter R. Brown
*Assistant Examiner*—Milton Nelson, Jr.
*Attorney, Agent, or Firm*—Baker & Daniels

[57] ABSTRACT

A device for the identification of objects such as patients, competitors and visitors to trade fairs, animals and baggage. The identification device comprises a strip-like tape made from a tear-resistant material and the attachment of one end of the tape to an arbitrary point on the tape so as to produce a closed strip loop. The tape has at least one field for information identifying the object, and the closed loop may be applied around a projecting part of the object associated with the information in question. The attachment of the aforementioned one end of the tape to an arbitrary point on the tape for producing the strip loop consists of a piece of double-sided adhesive tape applied at the aforementioned one end of the tape. This adhesive tape is covered prior to use by a removable protective film. The adhesive tape is of a type such that, when the joint forming the closed loop is parted at that point, the adhesive tape separates in a laminar fashion so that rejoining is not possible.

4 Claims, 1 Drawing Sheet

DEVICE FOR THE IDENTIFICATION OF OBJECTS

This is a continuation of application Ser. No. 07/761,817, filed Sep. 20, 1991, and now abandoned.

BACKGROUND OF THE INVENTION

The present invention relates to an arrangement for the identification of objects such as patients, competitors and visitors to trade fairs, animals and baggage, comprising a strip-like tape made from a tear-resistant material, which tape has at least one field for information identifying the object, and means for attaching one end of the tape to an arbitrary point on the tape so as to produce a closed strip loop intended to be placed around a projecting part of the object associated with the information in question, whereby the aforementioned means for producing the strip loop consist of a piece of double-sided adhesive tape applied at the aforementioned one end of the tape, which adhesive tape is covered prior to use by a removable protective film.

Identification arrangements of this kind are previously disclosed in, for example, U.S. Pat. No. 2,561,894, U.S. Pat. No. 2,098,164 and PCT WO 86/05303. These publications are concerned more specifically with identification strips for the identification of mothers and newborn infants and marking strips for baggage.

SUMMARY OF THE INVENTION

A common requirement applicable to all identification arrangements of this kind, irrespective of whether they are intended for persons, animals or things, is that the information on the arrangement shall be associated with a very considerable degree of probability with the object in question. This means that it must be as difficult as possible to change the identification arrangement or the information on it, for example .by accident, with malicious intent or for personal gain. This has resulted in a comparatively high price for previously disclosed identification arrangements. The object of the present invention is to make available an identification arrangement of the kind referred to by way of introduction, which is simple to produce, entails a comparatively low price, and creates great difficulty, to the extent even of making it impossible, to replace the identification arrangement for whatever reason.

This object is achieved in accordance with the invention in that the adhesive tape for producing the strip loop is of a kind such that, when the closed loop is parted at that point, the adhesive tape separates in a laminar fashion so that rejoining is not possible.

According to one particular characteristic of the invention, the tape is manufactured from, for example, a glass fibre-reinforced paper of a previously disclosed kind. A tape of this kind is highly resistant to mechanical influences, water-resistant and kind to the skin, and can easily be marked with information, for example in the form of a bar code, by printing, stamping or writing using a fountain pen or a ball point pen.

According to a second particular characteristic of the invention, information fields are present on both sides of the tape so as to offer full freedom of choice in respect of the manner of its application to the object. The information field can, of course, extend over the full surface of the tape.

BRIEF DESCRIPTION OF THE DRAWINGS

The invention is described below in greater detail with reference to the accompanying drawing, in which.

DETAILED DESCRIPTION OF THE INVENTION

Figure 1:
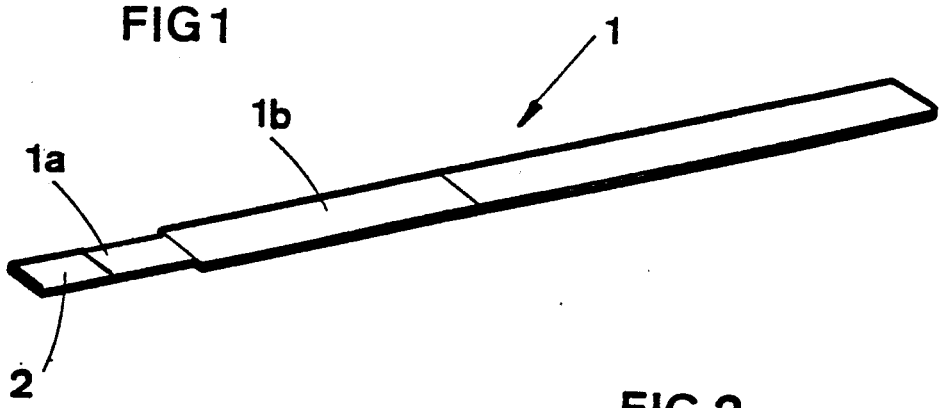
FIG. 1 illustrates in schematic form an embodiment of the identification arrangement in accordance with the invention.

An identification arrangement in accordance with the present invention comprises a strip-like tape 1, preferably made from a paper reinforced with, for example, glass fibre. Such paper is previously disclosed and is used for, amongst other things, external envelopes which are subject to certain requirements in respect of wearing strength and toughness. The use of other tape material may be considered, on condition that the aforementioned requirements are met. In the embodiment illustrated in the drawing, the tape 1 exhibits a stepped narrowed part 1*a* and a field 1*b* for information associated with a particular object. As an alternative, however, the aforementioned field may be positioned at one end of the tape 1 and may be shaped like an address label.

Figure 2:
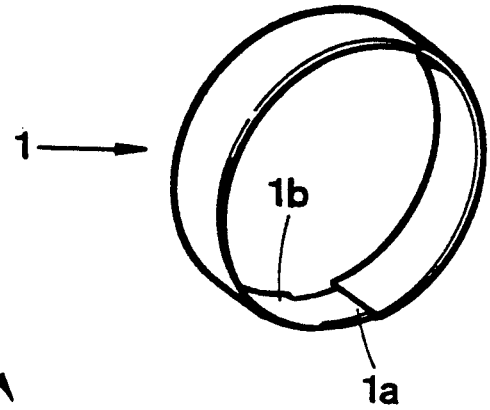
FIGS. 2 and 3 illustrate two alternative methods for producing a closed strip loop using the arrangement in accordance with FIG. 1.
Figure 3:
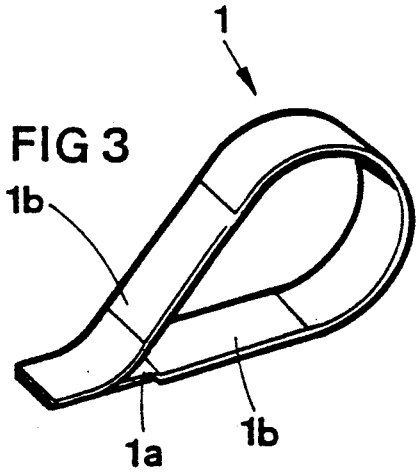
Figure 4:
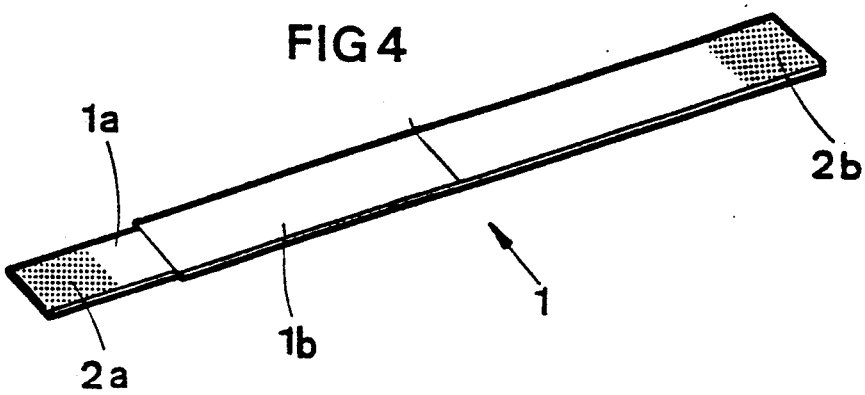
FIG. 4 shows in schematic form the strip loop in accordance with FIG. 3 after it has been parted.

In order to be able to form a closed strip loop in accordance with FIGS. 2 or 3 from the tape 1, a piece 2 of double-sided adhesive tape is applied to the narrowed part 1*a* of the tape 1. The piece 2 of adhesive tape is covered by a protective film of a previously disclosed kind before the tape 1 is used. After having removed this, the tape can be used to produce a closed loop in accordance with one or other of the alternatives shown in FIGS. 2 and 3, whereby the alternative in accordance with FIG. 2 is intended primarily for the identification of humans and animals, and the embodiment in accordance with FIG. 3 is intended for baggage, for example. As stated by way of introduction, and as can be appreciated from FIG. 3, the information field 1*b* is preferably on both sides of the tape 1. The information field can, as already stated by way of introduction, cover the whole surface of the tape. In accordance with the invention the double-sided adhesive tape 2 is of a kind such that, when the closed loop is parted at that point, the adhesive tape separates in a laminar fashion so that its two adhesion layers 2*a*, 2*b* remain in contact with the tape 1. These are illustrated by a pattern of dots in FIG. 4. It is now impossible to produce a closed loop again. The invention thus successfully prevents a loop previously closed for whatever reason from being reclosed once it has been parted.

It is obvious that the invention can be modified in many ways within the context of the idea of invention. This is particularly true of the design of the tape 1 and the positioning of the information field and the piece of double-sided adhesive tape by means of which the closed loop is produced.

We claim:

1. A device for the identification of objects, the identification device comprising:

a strip-like band made from a tear-resistant material, said strip-like band having a top and bottom surface and a field for receiving information to identify the object;

a piece of double sided adhesive tape having a first adhesive face attached to one end of said strip-like band, and a second adhesive face for attaching said one end of said strip-like band to an arbitrary point on said strip-like band and thereby providing a closed strip loop which is securable around a projecting part of an object associated with the received information; and a protective film covering said second adhesive face prior to use;

said adhesive tape laminarly separating when said closed strip loop is parted at the arbitrary point, whereby said first and second faces remain adhered to each of said one end and said arbitrary point such that rejoining of said tape is prevented.

2. Device in accordance with claim 1, wherein said field for information is present on both top and bottom surfaces of said strip-like band.

3. Device in accordance with claim 1, wherein said strip-like band is manufactured from a glass fibre-reinforced paper.

4. Device in accordance with claim 2, wherein said field for information is present on both top and bottom surfaces of said strip-like band.

* * * * *